US010821724B2

(12) United States Patent
Suetomi et al.

(10) Patent No.: US 10,821,724 B2
(45) Date of Patent: Nov. 3, 2020

(54) INKJET RECORDING DEVICE AND INKJET HEAD DRIVING METHOD

(71) Applicant: Konica Minolta, Inc., Tokyo (JP)

(72) Inventors: Yasuhiko Suetomi, Hino (JP); Takakazu Kuki, Fuchu (JP); Keiji Handa, Hachioji (JP); Yuusuke Kimura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/079,779

(22) PCT Filed: Feb. 7, 2017

(86) PCT No.: PCT/JP2017/004405
§ 371 (c)(1),
(2) Date: Aug. 24, 2018

(87) PCT Pub. No.: WO2017/145743
PCT Pub. Date: Aug. 31, 2017

(65) Prior Publication Data

US 2019/0070850 A1 Mar. 7, 2019

(30) Foreign Application Priority Data

Feb. 24, 2016 (JP) ..... 2016-033602

(51) Int. Cl.
*B41J 29/38* (2006.01)
*B41J 2/045* (2006.01)

(52) U.S. Cl.
CPC ..... *B41J 2/04541* (2013.01); *B41J 2/0452* (2013.01); *B41J 2/04543* (2013.01);
(Continued)

(58) Field of Classification Search
USPC ..... 347/9
See application file for complete search history.

(56) References Cited

U.S. PATENT DOCUMENTS 5,815,172 A 9/1998 Moh
8,517,490 B2 * 8/2013 Kanematsu ..... B41J 2/2135 347/12

FOREIGN PATENT DOCUMENTS

CN 1749012 A 3/2006
JP 05069544 A 3/1993
(Continued)

OTHER PUBLICATIONS

JPO Notice of Reasons for Refusal corresponding to Application No. 2018-501128; dated Nov. 5, 2019.
(Continued)

*Primary Examiner* — Lam S Nguyen
(74) *Attorney, Agent, or Firm* — Cantor Colburn LLP

(57) ABSTRACT

The present application is in at least one aspect directed to solving a problem of providing an inkjet recording device and an inkjet head driving method, in which instantaneous power consumption of a plurality of drive waveform generation circuits can be reduced while not requiring correction of an ink landing position without a complex structure. The problem is solved by dividing a plurality of pressure generating elements into first to n-th sets (n is an integer of 2 or more), and applying drive pulses to the pressure generating elements in the respective sets per every pixel period. The drive pulse combines any one of n time sharing drive waveforms (time sharing drive 1, 2, 3) with a common drive waveform (COM) as a rendering waveform, and the n time sharing drive waves are obtained by delaying a part of the rendering waveform by a time different from each other and have application timing deviated from each other.

20 Claims, 7 Drawing Sheets

(52) U.S. Cl.
CPC ..... *B41J 2/04573* (2013.01); *B41J 2/04581* (2013.01); *B41J 2/04586* (2013.01); *B41J 2/04588* (2013.01); *B41J 2202/10* (2013.01)

(56) References Cited

FOREIGN PATENT DOCUMENTS

| | | | |
|---|---|---|---|
| JP | H05069544 | A | 3/1993 |
| JP | 06040031 | A | 2/1994 |
| JP | H06040031 | A | 2/1994 |
| JP | 06127034 | A | 5/1994 |
| JP | 2006082259 | A | 3/2006 |
| JP | 3965700 | B2 | 8/2007 |

OTHER PUBLICATIONS

International Search Report corresponding to Application No. PCT/JP2017/004405; dated Apr. 25, 2017.
Written Opinion of the International Searching Authority corresponding to Application No. PCT/JP2017/004405; dated Apr. 25, 2017.
SIPO First Office Action corresponding to Application No. 201780012317.9; dated Jun. 4, 2019.
Extended European Search Report corresponding to Application No. 17756184.2-1019/3421237 PCT/JP2017004405; dated Feb. 11, 2019.
JPO Notice of Reasons for Refusal corresponding to JP2018-501128; dated Feb. 12, 2020.
EPO Office Action for corresponding to EP Application No. 17756184.2; dated May 20, 2020.

* cited by examiner

INKJET RECORDING DEVICE AND INKJET HEAD DRIVING METHOD

CROSS REFERENCE TO RELATED APPLICATIONS

This is the U.S. national stage of application No. PCT/JP2017/004405, filed on Feb. 7, 2017. Priority under 35 U.S.C. § 119(a) and 35 U.S.C. § 365(b) is claimed from Japanese Application No. 2016-033602, filed on Feb. 24, 2016, the disclosures all of which are also incorporated herein by reference.

TECHNICAL FIELD

The present invention relates to an inkjet recording device and an inkjet head driving method, and more specifically, relates to an inkjet recording device and an inkjet head driving method, in which a drive pulse is applied to a pressure generating element of the inkjet recording device to cause an inkjet head to jet ink droplets based on the drive pulse.

BACKGROUND ART

An inkjet recording device includes a drive waveform generation circuit, and image formation is performed by applying a drive pulse to a pressure generating element of an inkjet head by this drive waveform generation circuit. In recent years, a recording device with high definition and a high production rate is demanded, and higher nozzle density and faster drive are achieved in an inkjet recording device. However, simultaneous drive of a large number of densified channels at a high frequency causes problems such as increase in burden on a power supply circuit and the like due to increase in instantaneous power consumption, change in an ink jetting state caused by distortion of a waveform of a drive pulse.

In the related art, proposed is an inkjet recording device in which power consumption is calculated from received image data, and in a case where it is presumed that the power consumption exceeds a prescribed value, instantaneous power consumption is prevented from exceeding the prescribed value by differently setting a phase of a generated waveform in each drive waveform generation circuit (Patent Literature 1).

Additionally, proposed is an inkjet recording device in which pressure generating elements are divided into M sets of groups each including N pressure generating elements, and M drive waveform generation circuits (or one of an integral number of M) corresponding to the respective groups are provided, and the drive waveform generation circuits generate drive pulses having phases different from each other so as to prevent instantaneous power consumption from exceeding a prescribed value (Patent Literature 2).

CITATION LIST

Patent Literature

Patent Literature 1: JP 3965700 B
Patent Literature 2: JP 6-127034 A

SUMMARY OF INVENTION

Technical Problem

In inkjet recording devices disclosed in Patent Literature 1 and 2, a plurality of drive waveform generation circuits is provided, and instantaneous power consumption is reduced by differently setting phases of respective generated waveforms.

However, in the case of differently setting the phases of the respective generated waveforms, an ink landing position on a medium may be deviated by the phase difference. Therefore, in the received image data and the like, processing to correct such a deviation is required, and a structure may be more complex.

Particularly, in the technology disclosed in Patent Literature 1, a phase difference between respective generated waveforms is changed depending on a power consumption value calculated from received image data, and therefore, more complex processing is required to correct an ink landing position. Additionally, in this technology, required is a means to preliminarily calculate power consumption from received image data and perform processing to differently setting phases of respective generated waveforms, and therefore, the structure is more complex.

Considering the above situation, the present invention is directed to solving a problem of providing an inkjet recording device and an inkjet head driving method in which instantaneous power consumption of a plurality of drive waveform generation circuits can be suppressed while not requiring correction of an ink landing position without having a complex structure.

Solution to Problem

The above problem is solved by respective inventions below.

1. An inkjet recording device including:

an inkjet head having a plurality of nozzles and a plurality of pressure generating elements corresponding to the nozzles, the inkjet head being adapted to jet ink from each of the nozzles; and a drive pulse generation circuit that applies drive pulses to the plurality of pressure generating elements, in which the drive pulse generation circuit includes: first to n-th time sharing drive waveform generation circuits (n is an integer of 2 or more) respectively generating n time sharing drive waveforms obtained by delaying a part of a rendering waveform by a time different from each other, and having application timing deviated from each other; and a common drive waveform generation circuit generating a waveform of a remaining part of the rendering waveform, the plurality of pressure generating elements is divided into first to n-th sets (n is an integer of 2 or more), and pressure generating elements in each set correspond to the common drive waveform generation circuit and any one of the time sharing drive waveform generation circuits, and the drive pulse generation circuits apply, per certain set time, drive pulses to the pressure generating elements made to correspond to the drive pulse waveform generation circuits, and each drive pulse being a combination waveform combining a time sharing drive waveform generated from each time sharing drive waveform generation circuit with a common drive waveform generated from the common drive waveform generation circuit.

2. The inkjet recording device recited in above 1, in which a voltage change point of one of the n time sharing drive waveforms temporally coincides with a voltage change point of at least one of the common drive waveforms.

3. The inkjet recording device recited in above 1 or 2, in which a minimum value Δt of a timing deviation between the n time sharing drive waveforms is 50% or more of a falling time of a waveform element of the time sharing drive waveform.

4. The inkjet recording device recited in any one of above 1 to 3, in which wave peak values of the n time sharing drive waveforms are equal, and a maximum value $(n-1)\Delta t$ of a timing deviation between the time sharing drive waveforms is 20% or less of ½ of an acoustic resonance period of a pressure chamber communicating with the nozzle and having a volume changed by the pressure generating element.

5. The inkjet recording device recited in any one of above 1 to 4, in which each of the time sharing drive waveform generation circuits is formed of one circuit that generates a time sharing drive waveform having earliest application timing and n−1 circuits that include delay circuits having delay amounts different from each other.

6. The inkjet recording device recited in any one of above 1 to 5, in which pressure generating elements in adjacent sets among the sets of pressure generating elements in the inkjet head are each applied with a drive pulse having a time sharing drive waveform in which a timing deviation is a minimum value is $\Delta t$.

7. The inkjet recording device recited in any one of above 1 to 6, in which the plurality of nozzles is arranged in a plurality of rows in the inkjet head, an array of respective time sharing drive waveform generation circuits that apply drive pulses to respective sets of the pressure generating elements in a certain nozzle row is made to have an inverted array of an array of respective time sharing drive waveform generation circuits that apply drive pulses to respective sets of the pressure generating elements in another nozzle row.

8. The inkjet recording device recited in any one of above 1 to 6, in which the plurality of nozzles is arranged in a plurality of rows in the inkjet head, and there is a concentration difference in a formed image between respective sets of the pressure generating elements in a certain nozzle row, and respective sets of pressure generating elements in the certain nozzle row and respective sets of pressure generating elements in the other nozzle row located at positions corresponding to the respective sets of the pressure generating elements in the certain row are made to have concentrations deviated oppositely from an average concentration.

9. The inkjet recording device recited in any one of above 1 to 6, in which there is a factor that causes a difference in droplet speed between respective sets of the pressure generating elements in the inkjet head, and influence of the factor is canceled out by a deviation between the respective time sharing drive waveforms.

10. An inkjet head driving method including:

generating n time sharing drive waveforms (n is an integer of 2 or more) obtained by delaying a part of a rendering waveform by a time different from each other and having application timing deviated from each other, and generating a common drive waveform that is a remaining part of the rendering waveform;

dividing, into first to n-th sets (n is an integer of 2 or more), a plurality of pressure generating elements respectively corresponding to a plurality of nozzles in the inkjet head, and making pressure generating elements of each set correspond to any one of the respective time sharing drive waveforms and the common drive waveforms; and selecting one time sharing drive waveform every set time, and applying to a drive pulse to a pressure generating element made to correspond to the drive waveforms, each drive pulse having a combination waveform combining the selected time sharing drive waveform with the common drive waveform.

11. The inkjet head driving method recited in above 10, in which a voltage change point of one of the n time sharing drive waveforms temporally coincides with a voltage change point of at least one of the common drive waveforms.

12. The inkjet head driving method recited in above 10 or 11, in which the minimum value $\Delta t$ of the timing deviation between the n number of time sharing drive waveforms is 50% or more of a falling time of the waveform element of the time sharing drive waveform.

13. The inkjet head driving method recited in any one of above 10 to 12, in which wave peak values of the n time sharing drive waveforms are equal, and a maximum value $(n-1)\Delta t$ of a timing deviation between the time sharing drive waveforms is 20% or less of ½ of an acoustic resonance period of a pressure chamber communicating with the nozzle and having a volume changed by the pressure generating element.

14. The inkjet head driving method recited in any one of above 10 to 13, in which the respective time sharing drive waveforms are generated by using time sharing drive waveform generation circuits including: one circuit that generates a time sharing drive waveform having earliest application timing; and n−1 circuits having delay circuits in which delayed amounts are different from each other.

15. The inkjet head driving method recited in any one of above 10 to 14, in which pressure generating elements in adjacent sets among the sets of pressure generating elements in the inkjet head are applied with drive pulses each having a time sharing drive waveform in which a timing deviation is a minimum value is $\Delta t$.

16. The inkjet head driving method recited in any one of above 10 to 14, in which the plurality of nozzles is arranged in a plurality of rows in the inkjet head, an array of respective time sharing drive waveform generation circuits that apply drive pulses to respective sets of the pressure generating elements in a certain nozzle row is made to have an inverted array of an array of respective time sharing drive waveform generation circuits that apply drive pulses to respective sets of the pressure generating elements in another nozzle row.

17. The inkjet head driving method recited in any one of above 10 to 14, in which the plurality of nozzles is arranged in a plurality of rows in the inkjet head, and there is a concentration difference in a formed image between respective sets of the pressure generating elements in a certain nozzle row, and respective sets of pressure generating elements in the certain nozzle row and respective sets of pressure generating elements in the other nozzle row located at positions corresponding to the respective sets of the pressure generating elements in the certain row are made to have concentrations deviated oppositely from an average concentration.

18. The inkjet head driving method recited in any one of above 10 to 14, in which there is a factor that causes a difference in droplet speed between respective sets of the pressure generating elements in the inkjet head, and influence of the factor is canceled out by a deviation between the respective time sharing drive waveforms.

Advantageous Effects of Invention

According to the present invention, it is possible to provide an inkjet recording device and an inkjet head driving method in which instantaneous power consumption of a plurality of drive waveform generation circuits can be suppressed while not requiring correction of an ink landing position without a complex structure.

DESCRIPTION OF EMBODIMENTS

In the following, embodiments of the present invention will be described in detail with reference to the drawings.

[Structure of Inkjet Recording Device]

The present invention is suitably applied to an inkjet recording device including an inkjet head that jets ink from a nozzle by: deforming a wall of a pressure chamber filled with the ink by a pressure generating element; and changing a volume of the pressure chamber. When the wall of the pressure chamber is deformed by the pressure generating element, a drive pulse is applied to the pressure generating element by a drive pulse generation circuit.

Meanwhile, in the present invention, various kinds of known means can be adopted regardless of a specific means in order to apply a jetting pressure to the ink inside the pressure chamber. Additionally, an inkjet recording device to which the present invention is applied may be of various kinds of known systems such as a line type and a serial type, but in the following description, the present invention will be described with an example of a line type inkjet recording device.

Figure 1:
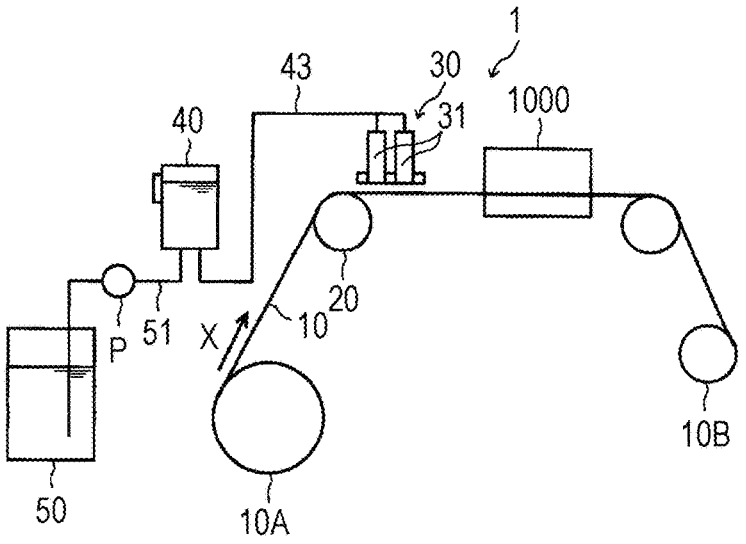
FIG. 1 is a schematic diagram illustrating a structure of a line type inkjet recording device.

FIG. 1 is a schematic diagram illustrating a structure of a line type inkjet recording device 1.

A long recording medium 10 wound in a roll shape is rolled out from an unrolling roll 10A in a direction of an arrow X, and conveyed by a drive means (not illustrated). Note that the direction of the arrow X indicates a conveyance direction of the recording medium 10 in all of respective drawings below.

The long recording medium 10 is rolled up around a back roll 20 and conveyed while being supported thereby. Ink is jetted from an inkjet head unit 30 toward the recording medium 10, and an image is formed based on image data. The inkjet head unit 30 has, in a width direction of the recording medium, a plurality of inkjet heads 31 conforming to a jet width. Note that the number of inkjet heads 31 may be one as far as a required jet width is secured by the single inkjet head 31.

Figure 2:
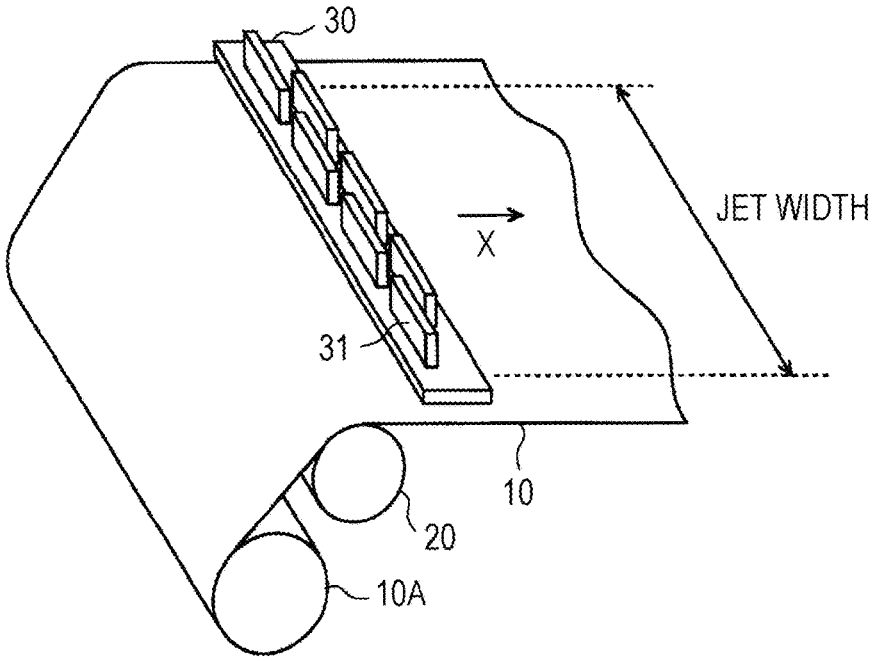
FIG. 2 is a view illustrating exemplary arrangement of an inkjet head of an inkjet head unit.

FIG. 2 is a view illustrating exemplary arrangement of the inkjet heads 31 of the inkjet head unit 30. In this example, all of the inkjet heads 31 are arranged at the same height with respect to an intermediate tank 40 that temporarily stores ink. Since the jet width in which one inkjet head 31 can jet the ink is narrower an outer shape dimension of the inkjet head 31, a plurality of inkjet heads 31 is arranged zigzag with respect to the conveyance direction of the recording medium 10 in order to perform jetting without any gap. In the example illustrated in FIG. 2, the plurality of inkjet heads 31 conforming to the jet width is arranged zigzag in two rows in a width direction of the recording medium 10.

Figure 3:
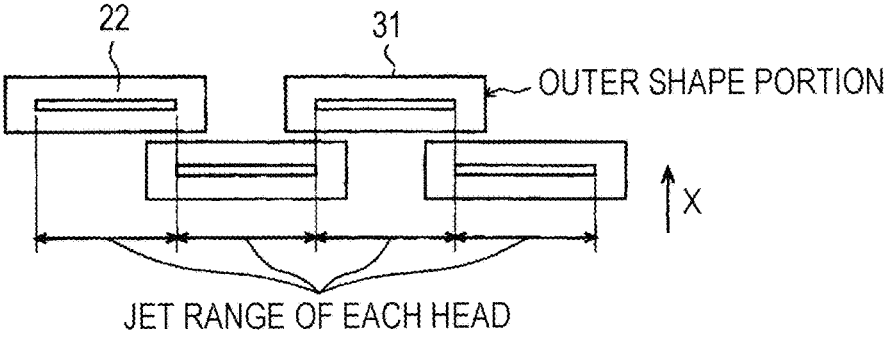
FIG. 3 is a diagram illustrating a relation between an outer shape, a jet width, and zigzag arrangement of the inkjet head.

FIG. 3 is a diagram illustrating a relation between an outer shape, a jet width, and zigzag arrangement of the inkjet heads 31. The number of the inkjet heads 31 and the number of rows in zigzag arrangement are set as appropriate in accordance with the jet width of each inkjet head 31 and the like, and not limited to the example of FIG. 3.

In FIG. 1, the ink is supplied to each of the inkjet heads 31 via a plurality of ink tubes 43 from the intermediate tank 40 that adjusts a back pressure of the ink in each inkjet head 31. Note that the ink tube 43 illustrated in the drawing includes the plurality of ink tubes.

The ink is supplied via a supply pipe 51 to the intermediate tank 40 by a feed pump P disposed in the middle of the supply pipe 51 from a storage tank 50 that stores the ink.

The recording medium 10 having an image formed is dried by a dryer 1000 and rolled up by the roll-up roll 10B. Note that the dryer unit 1000 may be unnecessary in a case where there is no problem in natural drying.

An inkjet head 31 records an image in a stationary state when the recording medium 10 is conveyed in the conveyance direction. During conveyance of the recording medium 10, an ink jetting state is changed by selecting a drive pulse of a rendering waveform based on image data every drive period.

Each inkjet head 31 is arranged such that a nozzle surface side faces a recording surface of the recording medium 10, and is electrically connected, via a flexible cable (not illustrated), to a drive pulse generation circuit (not illustrated here) that generates a drive pulse.

Figure 4A:
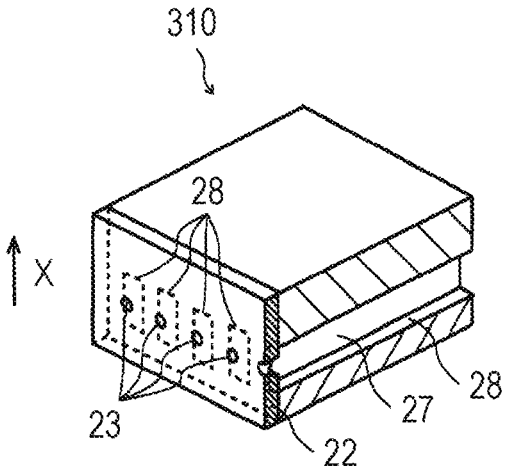
FIG. 4A and FIG. 4B illustrate views of an exemplary shear mode inkjet head.
Figure 4B:
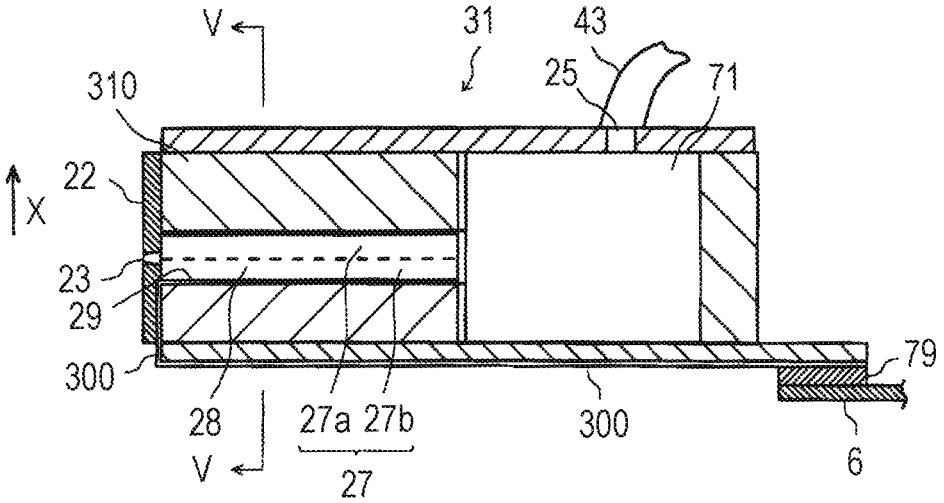

FIG. 4A and FIG. 4B illustrate views of an exemplary shear mode inkjet head 31 included in the inkjet recording device 1, FIG. 4A is a perspective view illustrating a cross-section of an external view, and FIG. 4B is a cross-sectional view from a side surface.

In the drawings, reference sign 310 indicates a head chip, and reference sign 22 indicates a nozzle plate joined to a front face of the head chip 310.

Note that, in the present specification, a surface side where ink is jetted from the head chip 310 will be referred to as "front surface", and a surface on the opposite side thereof will be referred to as "rear surface". Also, outer side surfaces of the head chip 310 positioned above and below while interposing channels provided in parallel will be referred to as "upper surface" and "lower surface", respectively.

The head chip 310 includes channel rows in which a plurality of ink channels 28 partitioned by partition walls 27 is provided in parallel. Here, the channel rows include 512 ink channels 28, but note that the number of ink channels 28 constituting the channel rows is not particularly limited.

Each partition wall 27 includes, as a pressure generating element, a piezoelectric element such as a PZT that is an electric/mechanical converting means. In the present embodiment, each partition wall 27 is formed of two piezoelectric materials 27*a* and 27*b* having different polarization directions. Note that the piezoelectric materials are needed to be provided at least in a part of each partition wall 27 and are arranged so as to be able to deform each partition wall 27.

A piezoelectric material used for the piezoelectric materials 27*a* and 27*b* is not particularly limited as far as the piezoelectric material causes deformation by applying a voltage, and known piezoelectric materials are used. As the piezoelectric material, a substrate made of an organic material may be used, but a substrate made of a piezoelectric nonmetallic material is preferable. As a substrate made of the piezoelectric nonmetallic material, a ceramic substrate formed through a process such as firing, a substrate formed through a coating and layer deposition processes, or the like is exemplified. As the organic material, an organic polymer, a hybrid material of an organic polymer and an inorganic material can be exemplified.

As the ceramic substrate, PZT($PbZrO_3$—$PbTiO_3$) and a third component added PZT may be used, and as the third component, $Pb(Mg_{1/3}Nb_{2/3})O_3$, $Pb(Mn_{1/3}Sb_{2/3})O_3$, $Pb(Co_{1/3}\ Nb_{2/3})O_3$, or the like may be used, and furthermore, the ceramic substrate can be formed using $BaTiO_3$, ZnO, $LiNbO_3$, $LiTaO_3$ or the like.

In the present embodiment, the two piezoelectric materials are bonded for use such that the polarization directions thereof are opposite to each other, whereby an amount of shear deformation is twice a case of using one piezoelectric material, and therefore, there is a merit in which a drive voltage can be reduced to ½ to achieve the same deformation amount.

On the front surface and the rear surface of the head chip 310, an opening on a front surface side of each ink channel 28 and an opening on a rear surface side thereof are opened. Each ink channel 28 is a straight type in which a size and a shape are substantially unchanged in a length direction extending from the opening on the rear surface side to the opening on the front surface side.

The opening on the front surface side of the ink channel 28 is connected to a nozzle 23 formed in a nozzle plate 22, and the opening on the rear surface side is connected to an ink tube 43 via a common ink chamber 71 and an ink supply port 25.

An electrode 29 made of a metal film is formed in close contact with an entire inner surface of each ink channel 28. The electrode 29 inside the ink channel 28 is electrically connected to a drive pulse generation circuit (not illustrated here) via a connection electrode 300, an anisotropic conductive film 79, and a flexible cable 6.

When a drive pulse from the drive pulse generation circuit is applied between the electrodes 29 inside the ink channels 28, the partition wall 27 made of a piezoelectric element is bent and deformed from a junction surface between an upper wall portion 27*a* and a lower wall portion 27*b*. A pressure wave is generated inside each ink channel 28 due to this bent deformation of the partition wall 27, and the pressure is applied in order to jet, from the nozzle 23, the ink contained inside the ink channel 28.

Figure 5A:
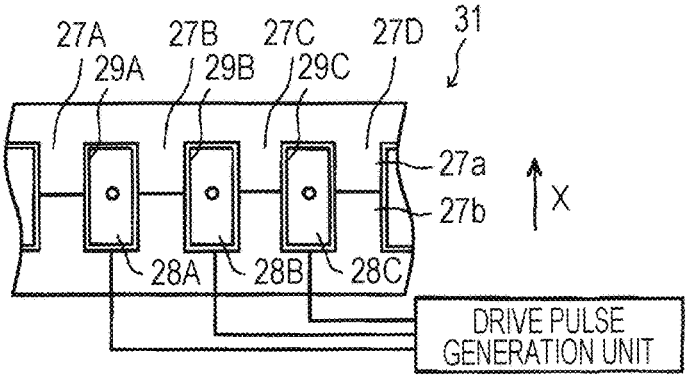
FIG. 5A, FIG. 5B and FIG. 5C illustrate diagrams to describe exemplary volume change of pressure chambers.
Figure 5B:
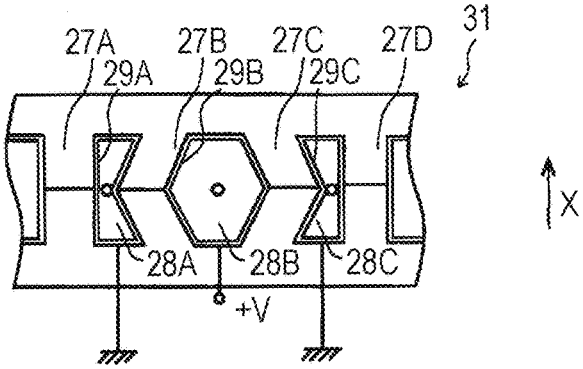
Figure 5C:
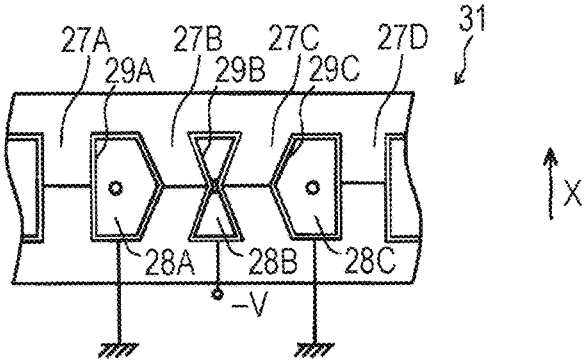

FIG. 5A, FIG. 5B and FIG. 5C illustrate vertical cross-sectional views taken along a line v-v in FIG. 4B to describe exemplary volume change of an ink channel (pressure chamber).

As illustrated in FIG. 5A, in a state in which no drive pulse is applied to electrodes 29A, 29B, and 29C inside ink channels 28A, 28B, and 28C adjacent to each other (steady state), all of partition walls 27A, 27B 27C, and 27D are not deformed.

An expansion pulse (+V) is used as a drive pulse at the time of expanding a volume inside an ink channel 28. When the electrodes 29A and 29C of the ink channels 28A and 28C adjacent to the ink channel 28B to be expanded are grounded and additionally an expansion pulse (+V) from the drive pulse generation circuit is applied to the electrode 29B of the ink channel 28B to be expanded, shearing deformation is caused on a joining surface between an upper wall portion 27*a* and a lower wall portion 27*b* in each of both the partition walls 27B and 27C of the ink channel 28B to be expanded. As a result, as illustrated in FIG. 5B, both of the partition walls 27B and 27C are bent and deformed outward, thereby expanding the volume of the ink channel 28B to be expanded. Due to this bent deformation, a negative pressure wave is generated inside the ink channel 28B, and the ink from a common flow path can be made to flow into the ink channel 28B.

On the other hand, a contraction pulse (−V) is used as a drive pulse at the time of contracting the volume inside an ink channel 28. When the electrodes 29A and 29C of the ink channels 28A and 28C adjacent to the ink channel 28B to be contracted are grounded and additionally a contraction pulse (−V) from the drive pulse generation circuit is applied to the electrode 29B of the ink channel 28B to be expanded, shearing deformation in a direction opposing to the direction at the time of the above-described expansion is caused on the joining surface between the upper wall portion 27*a* and the lower wall portion 27*b* in each of both the partition walls 27B and 27C of the ink channel 28B to be contracted. As a result, as illustrated in FIG. 5C, both of the partition walls 27B and 27C are bent and deformed inward and contracts the volume of the ink channel 28B to be contracted. Due to this bent deformation, a positive pressure wave is generated inside the ink channel 28B, and the ink can be jetted from a corresponding nozzle 23.

Meanwhile, in the ink channels (pressure chambers) illustrated in FIG. 5A, FIG. 5B and FIG. 5C adjacent ink channels cannot be expanded or contracted at the same time, and therefore, it is preferable to perform so-called three-cycle drive. In the three-cycle drive, all of ink channels are divided into three groups, and adjacent ink channels are controlled in a time sharing manner, but the three-cycle driving differs from time sharing drive in the present invention described later.

Additionally, the present invention can also be applied to a so-called independent type inkjet head in which a jetting channel and a non-jetting channel (dummy channel) are alternately arranged. In the independent type inkjet head, since adjacent ink channels can be expanded or contracted at the same time, there is no need to perform the three-cycle drive, and independent driving can be performed.

Embodiments described below can be applied to both of an inkjet head of the three-cycle drive type and an inkjet head of the independent driving type in the same manner.

<Configuration of Drive Pulse Generation Circuit>

Figure 6:
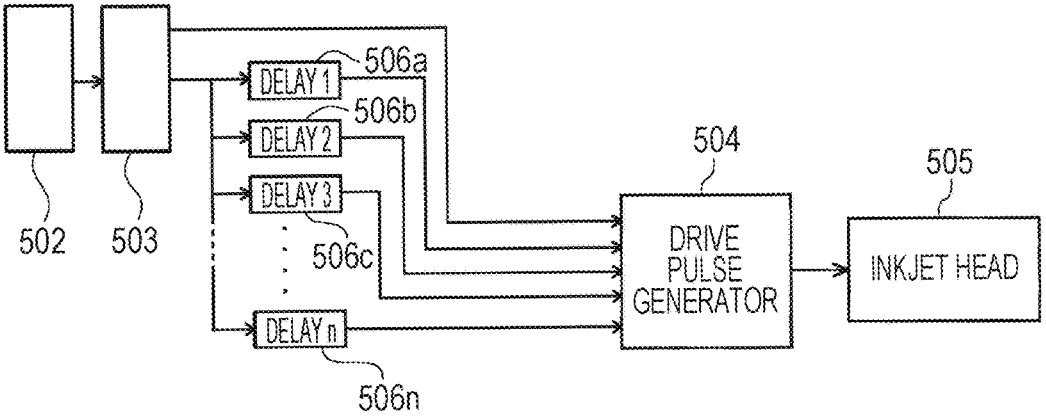
FIG. 6 is a block diagram illustrating an exemplary drive pulse generation circuit.

FIG. 6 is a block diagram illustrating an exemplary drive pulse generation circuit.

In FIG. 6, reference sign 502 indicates a memory in which image data serving as a base of a rendering waveform is stored. Reference sign 503 indicates a separator that constitutes a time sharing drive waveform generation circuit and a common drive waveform generation circuit, and performs outputting after separating a rendering waveform based on image data into a part and a remaining part. Reference signs 506*a*, 506*b*, 506*c*, . . . , 506*n* indicate first to n-th delay circuits constituting the time sharing drive waveform generation circuit. Reference sign 504 indicates a drive pulse generator that generates a drive pulse based on a drive waveform generated by the time sharing drive waveform generation circuit and the common drive waveform generation circuit. Reference numeral 505 indicates an inkjet head.

The separator 503 and any one of the first to n-th delay circuits 506*a*, 506*b*, 506*c*, . . . , 506*n* constitute a time sharing drive waveform generation circuit. A circuit including the first delay circuit 506*a* is a first time sharing drive waveform generation circuit, a circuit including the second delay circuit 506*b* is a second time sharing drive waveform generation circuit, and similarly, a circuit including the n-th time delay circuit 506*n* is an n-th time sharing drive waveform generation circuit. These time sharing drive waveform generation circuits generate time sharing drive waveforms in order to perform time sharing drive for the respective piezoelectric elements. Additionally, the separator 503 also serves as a common drive waveform generation circuit.

The separator 503 generates a rendering waveform including an expansion waveform to expand a volume inside an ink channel 28 and a contraction waveform to contract a volume in an ink channel 28 on the basis of image data stored in the memory 502. The rendering waveform is separated into an expansion waveform and a contraction waveform, and then output. Incidentally, the expansion waveform and the contraction waveform may be separated from the rendering waveform based on image data, or may be generated individually based on image data.

In the present embodiment, the contraction waveform is transmitted to the drive pulse generator 504, and the expansion waveform is transmitted to the drive pulse generator 504 via any one of the first to n-th delay circuits 506*a*, 506*b*, 506*c*, . . . , 506*n* (where n is an integer of 2 or more). Incidentally, the expansion waveform may also be directly transmitted to the drive pulse generator 504, and the contraction waveform may be transmitted to the drive pulse generator 504 via any one of the first to n-th delay circuits 506*a*, 506*b*, 506*c*, . . . , 506*n*.

The drive pulse generator 504 generates a drive pulse set to a predetermined drive voltage value by combining a contraction waveform (or expansion waveform) received from the separator 503 with an expansion waveform (or contraction waveform) received via any one of the first to n-th delay circuits 506*a*, 506*b*, 506*c*, . . . , 506*n*. The drive pulse is a pulse set to the predetermined voltage value while keeping a waveform of each drive waveform, and there is no temporal change (change in a pulse width) for each drive waveform. The drive pulse generator 504 outputs, within one drive cycle, respective drive pulses to piezoelectric elements provided in each of a plurality of nozzles of the inkjet head 505. For example, describing using the above-described example, a drive pulse is output, within one pixel period, to each of the piezoelectric elements included in a partition wall 27 from the drive pulse generator 504 via the flexible cable 6, connection electrode 300, and electrode 29 inside the ink channel.

In the first to n-th delay circuits 506*a*, 506*b*, 506*c*, . . . , 506*n*, a delay time of the second delay circuit is larger than a delay time of the first delay circuit, a delay time of the third delay circuit is larger than the delay time of the second delay circuit, and similarly, a delay time of the n-th delay circuit is larger than a (n−1)th delay time of a delay circuit.

Note that the delay time of the first delay circuit may be zero, and in this case, the first delay circuit is unnecessary. In this case, the time sharing drive waveform generation circuit is formed of: one circuit that does not include a delay circuit and generates a time sharing drive waveform having the earliest application timing; and n−1 circuits that include delay circuits having delay amounts different from each other.

The common drive waveform generation circuit generates a common drive waveform that drives respective piezoelectric elements at the same time. Note that the common drive waveform generation circuit may be a plurality of circuits generating different common drive waveforms.

In the inkjet head 505, the plurality of piezoelectric elements is divided into first to n-th sets (where n is an integer of 2 or more). Piezoelectric elements belonging to the same set are each applied with the same drive pulse at the same timing. Piezoelectric elements in the respective sets are made to correspond to the common drive waveform generation circuit and any one of the time sharing drive waveform generation circuits.

More specifically, the piezoelectric elements in the first set are made to correspond to the first time sharing drive waveform generation circuit and the common drive waveform generation circuit. The piezoelectric elements in the second set are made to correspond to the second time sharing drive waveform generation circuit and the common drive waveform generation circuit. Similarly, the piezoelectric elements in the n-th set are made to correspond to the n-th time sharing drive waveform generation circuit and the common drive waveform generation circuit.

The drive pulse generator 504 applies, within a set time (one pixel period), combined drive pulses respectively combining time sharing drive waveforms having passed through the respective delay circuits 506*a*, 506*b*, 506*c*, . . . , 506*n* with common drive waveforms having passed through the separator 503 to the piezoelectric elements in the respective sets made to correspond to the respective drive waveform generation circuits.

More specifically, each piezoelectric element in the first set is applied with a drive pulse having a combination waveform combining a time sharing drive waveform generated from the first time sharing drive waveform generation circuit with a common drive waveform generated from the common drive waveform generation circuit. Each piezoelectric element in the second set is applied with a drive pulse having a combination waveform combining a time sharing drive waveform generated from the second time sharing drive waveform generation circuit with a common drive waveform generated from the common drive waveform generation circuit. Similarly, each piezoelectric element in the n-th set is applied with a drive pulse having a combination waveform combining a time sharing drive waveform generated from the n-th time sharing drive waveform generation circuit with a common drive waveform generated from the common drive waveform generation circuit.

Figure 7:
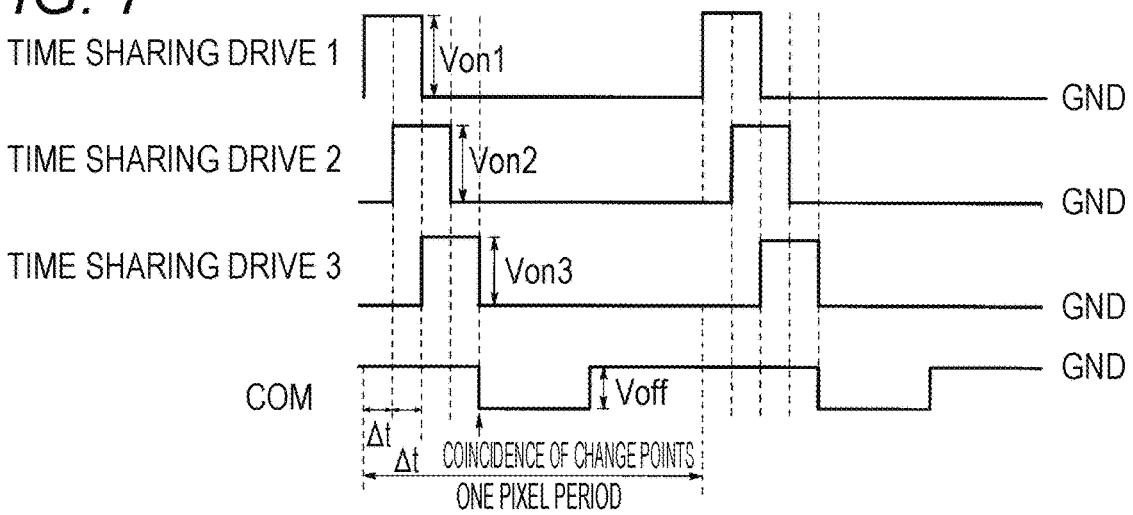
FIG. 7 is a graph illustrating exemplary drive pulses.

FIG. 7 is a graph illustrating exemplary drive pulses, in which a vertical axis represents a voltage and a horizontal axis represents time.

In an embodiment illustrated in FIG. 7, the drive pulse generation circuit has three time sharing drive waveform generation circuits (n=3) and one common drive waveform generation circuit. In this case, the time sharing drive waveform generation circuits have first to third delay circuits 506*a*, 506*b*, and 506*c*.

In FIG. 7, GND has a potential (also referred to as a reference voltage) in a steady state (state where no pulse exists). In the present embodiment, in one pixel period, each piezoelectric element in the first set is applied with a drive pulse combining an expansion pulse based on an expansion waveform generated from the first time sharing drive waveform generation circuit (time sharing drive 1) with a contraction pulse (COM) based on a contraction waveform generated from the common drive waveform generation circuit.

Here, a pulse is a rectangular wave having a constant voltage wave peak value, and in a case where a reference voltage GND is defined as 0% and a voltage at the wave peak value is 100%, the pulse represents a waveform in which both of a rising time and a falling time of the voltage between 10% and 90% are within ½ of an acoustic length (AL), preferably, within ¼ thereof "AL" stands for an acoustic length, which is ½ of an acoustic resonance period of a pressure wave in an ink channel 28. The "AL" is obtained as a pulse width in which a flight speed of a droplet becomes maximal when the flight speed of a jetted droplet is measured at the time of applying a rectangular wave drive signal to a drive electrode and a pulse width of the rectangular wave is changed while keeping a voltage value of the rectangular wave constant. The pulse width is defined as a time from a rising point 10% from the reference voltage GND to a falling point 10% from a voltage at the wave peak value. Note that, in the present invention, a drive pulse is not limited to a rectangular wave, and may be a trapezoidal wave or the like.

An expansion pulse is a pulse that expands a volume of a pressure chamber from a volume in the steady state. An expansion pulse based on a time sharing drive waveform generated from the first time sharing drive waveform generation circuit changes a voltage from the reference voltage GND to a voltage at the wave peak value Von1, holds the voltage at the wave peak value Von1 for a predetermined time, and change the voltage to the reference voltage GND again. A contraction pulse is a pulse that contracts a volume of a pressure chamber from a volume in the steady state, and changes a voltage from the reference voltage GND to a voltage at the wave peak value Voff, holds the voltage at the wave peak value Voff for a predetermined period, and changes the voltage to the reference voltage GND again.

Each piezoelectric element in the second set is applied with a drive pulse combining an expansion pulse based on an expansion waveform generated from the second time sharing drive waveform generation circuit (time sharing drive 2) with a contraction pulse (COM) based on a contraction waveform generated from the common drive waveform generation circuit.

The expansion pulse based on the time sharing drive waveform generated from the second time sharing drive waveform generation circuit changes a voltage from the reference voltage GND to a voltage at the wave peak value Von2, holds the voltage at the wave peak value Von2 for a predetermined time, and changes the voltage to the reference voltage GND again.

Each piezoelectric elements in the third set is applied with a drive pulse combining an expansion pulse based on an expansion waveform generated from the third time sharing drive waveform generation circuit (time sharing drive 3) with a contraction pulse (COM) based on the contraction waveform generated from the common drive waveform generation circuit.

The expansion pulse based on the time sharing drive waveform generated from the third time sharing drive waveform generation circuit changes a voltage from the reference voltage GND to a voltage at the wave peak value Von3, holds the voltage at the wave peak value Von3 for a predetermined time, and changes the voltage to the reference voltage GND again.

As illustrated in FIG. 7, the time sharing drive 2 is delayed by Δt from the time sharing drive 1, and the time sharing drive 3 is delayed by Δt from to the time sharing drive 2 and delayed by 2Δt from the time sharing drive 1. In this case, a minimum value of a timing deviation in each expansion pulse based on each time sharing drive waveform is Δt, and a maximum value is (n−1)Δt.

When piezoelectric elements in the first to third sets are each applied with the above-described drive pulse, an expansion pulse applied to a piezoelectric element in each set is delayed by any one of the first to third delay circuits 506*a*, 506*b*, and 506*c*, and therefore, instantaneous power consumption is reduced.

In order to reduce the instantaneous power consumption, it is preferable that the minimum value Δt of a timing deviation between n time sharing drive waveforms be 50% or more of a falling time t that is a waveform element of a time sharing drive waveform [100(Δt/t)≥50]. The falling time t represents: a time during which a voltage is changed from the voltage at the wave peak value Von1 to the reference voltage GND in the time sharing drive 1; a time during which a voltage is changed from the voltage at the wave peak value Von2 to the reference voltage GND in the time sharing drive 2; and a time during which a voltage is changed from the voltage at the wave peak value Von3 to the reference voltage GND in the time sharing drive 3.

Furthermore, in each of the piezoelectric elements in the first to the third sets applied with the drive pulses, an ink landing position on a medium is hardly deviated because piezoelectric elements in the respective sets have a common waveform that is a main cause of ink jetting timing, in other words, have common timing to start contraction of a volume of a pressure chamber.

Here, it is preferable that at least one voltage change point in an expansion pulse based on an expansion waveform generated from a time sharing drive waveform generation circuit temporally coincides with at least one voltage change point in a contraction pulse based on a contraction waveform generated from a common drive waveform generation circuit. In the present embodiment, a falling point of an expansion pulse based on an expansion waveform generated from the third time sharing drive waveform generation circuit (time sharing drive 3) coincides with a falling point of a contraction pulse (COM) based on a contraction waveform generated from the common drive waveform generation circuit. Consequently, piezoelectric elements in each set have common waveforms which are to be the main causes of the ink jetting timing, and an ink landing position on a medium is more hardly deviated.

Additionally, in a case where the voltages at the wave peak values Von1, Von2, and Von3 of drive pulses based on the n time sharing drive waveforms are equal to each other, it is preferable that the maximum value (n−1)Δt of a timing deviation between the drive pulses based on the respective time sharing drive waveforms be 20% or less of the acoustic length (AL: ½ of an acoustic resonance period of a pressure chamber) [100(n−1)Δt/AL≤20]. In a case where [(n−1)Δt/AL] exceeds 20%, weak jetting is easily caused, and an ink jetting state may be deteriorated.

Figure 8:
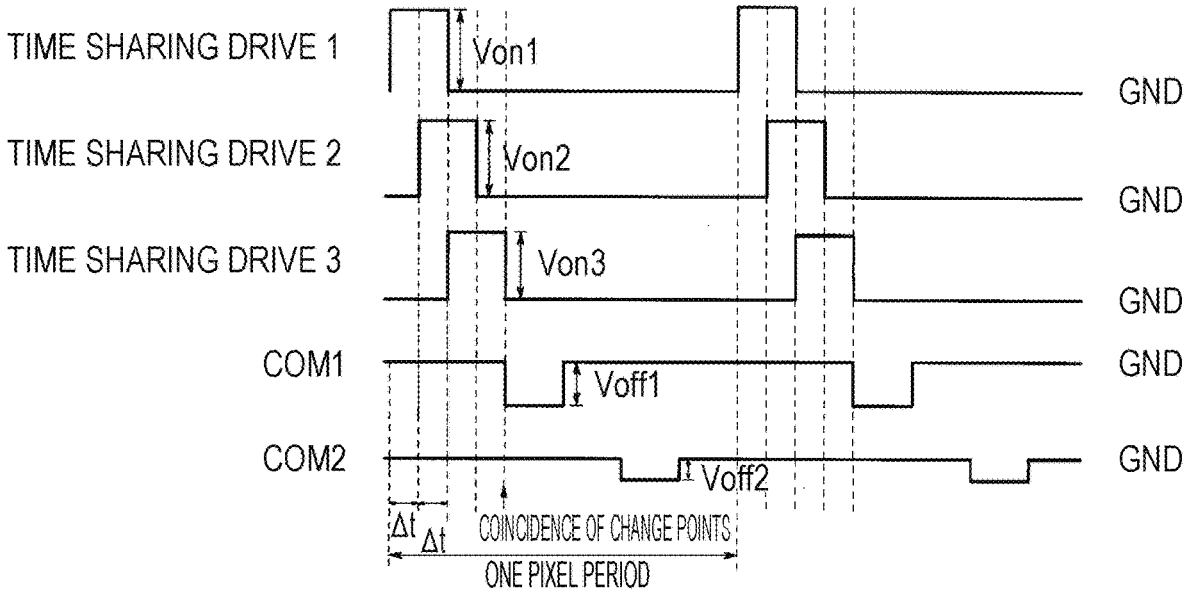
FIG. 8 is a graph illustrating other exemplary drive pulses.

FIG. 8 is a graph illustrating other exemplary drive pulses, in which a vertical axis represents a voltage and a horizontal axis represents time.

In an embodiment illustrated in FIG. 8, the drive pulse generation circuit has three time sharing drive waveform generation circuits (n=3) and two common drive waveform generation circuits. In this case, the time sharing drive waveform generation circuits have first to third delay circuits 506*a*, 506*b*, and 506*c*.

In FIG. 8, GND has a potential (also referred to as the reference voltage) in a steady state (state where no pulse exists). In the present embodiment, during one pixel period, each piezoelectric elements in the first set is applied with a drive pulse combining an expansion pulse based on an expansion waveform generated from the first time sharing drive waveform generation circuit (time sharing drive 1) with contraction pulses (COM1, COM2) based on contraction waveforms generated from the common drive waveform generation circuits.

An expansion pulse is a pulse that expands a volume of a pressure chamber from a volume in the steady state. An expansion pulse based on a time sharing drive waveform generated from the first time sharing drive waveform generation circuit changes a voltage from the reference voltage GND to a voltage at the wave peak value Von1, holds the voltage at the wave peak value Von1 for a predetermined time, and change the voltage to the reference voltage GND again. A contraction pulse is a pulse that contracts the volume of the pressure chamber from the volume in the steady state, and changes a voltage from the reference voltage GND to voltages at the wave peak values Voff1, Voff2, holds the voltages at the wave peak values Voff1 and Voff2 for a predetermined period, and changes the voltages to the reference voltage GND again.

Each piezoelectric element in the second set is applied with a drive pulse combining an expansion pulse based on an expansion waveform generated from the second time sharing drive waveform generation circuit (time sharing drive 2) with contraction pulses (COM1, COM2) based on contraction waveforms generated from the common drive waveform generation circuits.

The expansion pulse based on the time sharing drive waveform generated from the second time sharing drive waveform generation circuit changes a voltage from the reference voltage GND to a voltage at the wave peak value Von2, holds the voltage at the wave peak value Von2 for a predetermined time, and changes the voltage to the reference voltage GND again.

Each piezoelectric element in the third set is applied with a drive pulse combining an expansion pulse based on an expansion waveform generated from the third time sharing drive waveform generation circuit (time sharing drive 3) with contraction pulses (COM1, COM2) based on contraction waveforms generated from the common drive waveform generation circuits.

The expansion pulse based on the time sharing drive waveform generated from the third time sharing drive waveform generation circuit changes a voltage from the reference voltage GND to a voltage at the wave peak value Von3, holds the voltage at the wave peak value Von3 for a predetermined time, and changes the voltage to the reference voltage GND again.

As illustrated in FIG. 8, the time sharing drive 2 is delayed by Δt from the time sharing drive 1, and the time sharing drive 3 is delayed by Δt from to the time sharing drive 2 and delayed by 2Δt from the time sharing drive 1. In this case, a minimum value of a timing deviation in each expansion pulse based on each time sharing drive waveform is Δt, and a maximum value is (n−1)Δt.

When piezoelectric elements in the first to third sets are each applied with the above-described drive pulse, an expansion pulse applied to a piezoelectric element in each set is delayed by any one of the first to third delay circuits 506*a*, 506*b*, and 506*c*, and therefore, instantaneous power consumption is reduced.

In order to reduce the instantaneous power consumption, it is preferable that the minimum value Δt of a timing deviation between n time sharing drive waveforms be 50% or more of a falling time t that is a waveform element of a time sharing drive waveform [100(Δt/t)≥50].

Furthermore, in each of the piezoelectric elements in the first to the third sets applied with the drive pulses, an ink landing position on a medium is hardly deviated because piezoelectric elements in the respective sets have a common waveform that is a main cause of ink jetting timing, in other words, have common timing to start contraction of a volume of a pressure chamber.

Here, it is preferable that at least one voltage change point in an expansion pulse based on an expansion waveform generated from a time sharing drive waveform generation circuit temporally coincides with at least one voltage change point in a contraction pulse based on a contraction waveform generated from a common drive waveform generation circuit. In the present embodiment, a falling point of an expansion pulse based on an expansion waveform generated from the third time sharing drive waveform generation circuit (time sharing drive 3) coincides with a falling point of a contraction pulse (COM1) based on a contraction waveform generated from the common drive waveform generation circuit. Consequently, piezoelectric elements in each set have common waveforms which are to be the main causes of the ink jetting timing, and an ink landing position on a medium is more hardly deviated.

Additionally, in a case where the voltages at the wave peak values Von1, Von2, and Von3 of drive pulses based on the n time sharing drive waveforms are equal to each other, it is preferable that the maximum value (n−1)Δt of a timing deviation between the drive pulses based on the respective time sharing drive waveforms be 20% or less of the acoustic length (AL: ½ of an acoustic resonance period of a pressure chamber) [100(n−1)Δt/AL≤20]. In a case where [(n−1)Δt/AL] exceeds 20%, weak jetting is easily caused, and an ink jetting state may be deteriorated.

<Arrangement of Piezoelectric Elements in Each Set (1)>

Next, arrangement of piezoelectric elements in each set to which the above-mentioned drive pulse is applied will be described.

Figure 9:
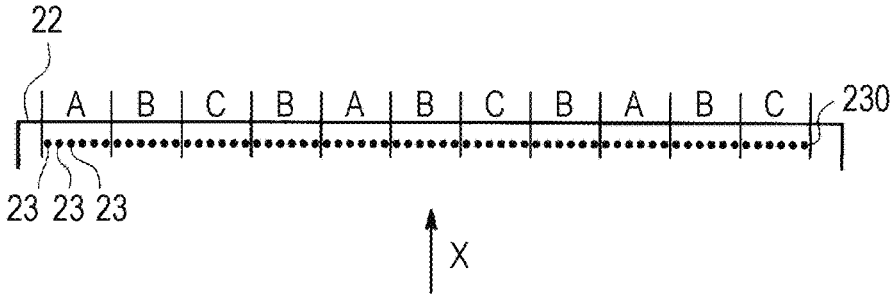
FIG. 9 is a diagram illustrating an ink jetting surface of an inkjet head.

FIG. 9 is a diagram illustrating an ink jetting surface of an inkjet head. One nozzle rows 230 constituted by a plurality of nozzles 23 is provided, and the nozzles 23 are arrayed in a direction orthogonal to the conveyance direction of the recording medium 10 (direction of an arrow X).

In the present embodiment, illustrated is a case where the drive pulse generation circuit includes three time sharing drive waveform generation circuits (n=3).

As illustrated in FIG. 9, a single piezoelectric element is or two or more adjacent piezoelectric elements are set as one block, and each block is allocated to any one of the first to third sets. Assume that a set of piezoelectric elements to which the time sharing drive 1 is applied (first set) is defined as "A", a set of piezoelectric elements to which the time sharing drive 2 is applied (second set) is defined as "B", and a set of piezoelectric elements to which the time sharing drive 3 is applied (third set) is defined as "C".

Respective sets of piezoelectric elements are arrayed with respect to an array direction of nozzles 23 such that a time difference of the time sharing drive pulses (drive pulses based on time sharing drive waveforms) between adjacent sets becomes the minimum value Δt but does not become 2Δt. For example, in a case of arraying the respective sets of piezoelectric elements as "A, B, C, B, A, B, C, B, A, B, C, . . . ", a time difference of the time sharing drive pulses between adjacent sets becomes the minimum value Δt in any of the sets.

Thus, since the respective sets of piezoelectric elements are arrayed such that a time difference of time sharing drive pulses between adjacent sets becomes minimum, it is possible to minimize: a deviation of ink jet timing between the respective sets; and influence of a concentration difference on a formed image.

<Arrangement of Piezoelectric Elements of Each Set (2)>

Figure 10:
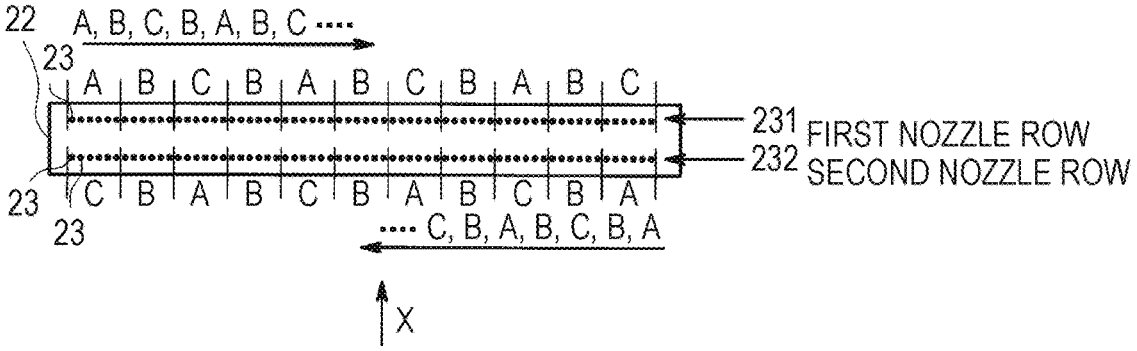
FIG. 10 is a diagram illustrating another exemplary ink jetting surface of an inkjet head.

FIG. 10 is a diagram illustrating an ink jetting surface of an inkjet head. Two Nozzle rows 231 and 232 are provided, and nozzles 23 are arrayed in a direction orthogonal to the conveyance direction of the recording medium 10 (direction of an arrow X).

The present embodiment is a case where the drive pulse generation circuit has three time sharing drive waveform generation circuits (n=3), the time sharing drive 2 is delayed by Δt from the time sharing drive 1, the time sharing drive 3 is delayed by Δt from the time sharing drive 2. In this case also, as illustrated in FIG. 10, a single piezoelectric element is or two or more adjacent piezoelectric elements are set as one block, and each block is allocated to any one of the first to third sets in a manner similar to the above-described case. Assume that a set of piezoelectric elements to which the time sharing drive 1 is applied (first set) is defined as "A", a set of piezoelectric elements to which the time sharing drive 2 is applied (second set) is defined as "B", and a set of piezoelectric elements to which the time sharing drive 3 is applied (third set) is defined as "C".

In a so-called single pass printer or the like, as illustrated in FIG. 10, a plurality of nozzle rows 231 and 232 parallel to each other is arranged in the conveyance direction of the recording medium 10 (direction of an arrow X). In this case, in each of the nozzle rows 231 and 232, there is a concentration difference in jetted ink between the respective sets of piezoelectric elements, and concentration distribution of the jetted ink has the same tendency in each of the nozzle rows 231 and 232, and also in a case where the concentration distribution is not laterally symmetric in the drawing, a large difference in a formed image may be caused between one end side and the other end side in each of the nozzle rows 231 and 232.

Therefore, by setting arrangement of the respective sets of piezoelectric elements in a first nozzle row 231 and arrangement of the respective sets of piezoelectric elements in a second nozzle row 232 in a manner directionally inverted to each other, concentration distribution in each of the nozzle rows 231 and 232 can be canceled out and be made uniform.

More specifically, when the respective sets of piezoelectric elements in the first nozzle row 231 are arrayed as "A, B, C, B, A, B, C, . . . , B, A, B, C", the respective sets of piezoelectric elements in the second nozzle row 232 are arrayed as "C, B, A, B, . . . , C, B, A, B, C, B, A" in a manner inverted to the array in the first nozzle row 231.

Even in a case where the number of nozzle rows is three or more, array of respective time sharing drive waveform generation circuits to apply drive pulses to the respective sets of piezoelectric elements in one nozzle row is set so as to have an array directionally inverted from an array of respective time sharing drive waveform generation circuits to apply drive pulses to the respective sets of piezoelectric elements in another nozzle row.

Thus, since there is the nozzle row 232 that has the array of the respective sets of piezoelectric elements inverted from the array of the respective sets of piezoelectric elements in the certain nozzle row 231, concentration distribution in each of the nozzle rows 231 and 232 can be canceled out and the concentration distribution in a formed image can be made uniform. Meanwhile, even in a case where the number of nozzle rows is an odd number, influence of concentration distribution in each of nozzle rows can be reduced.

<Arrangement of Piezoelectric Elements of Each Set (3)>

Figure 11:
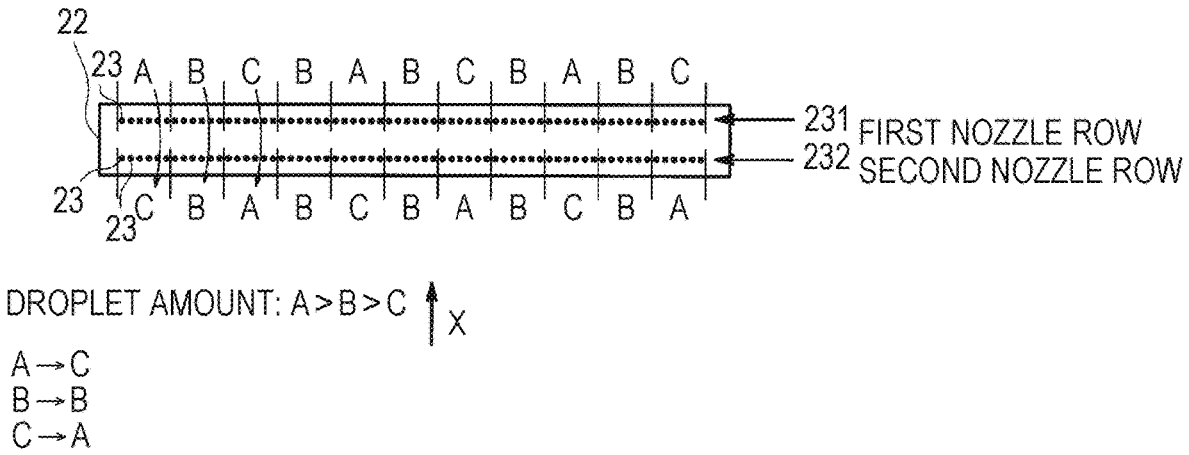
FIG. 11 is a diagram illustrating still another exemplary ink jetting surface of an inkjet head.

FIG. 11 is a diagram illustrating still another exemplary ink jetting surface of the inkjet head. Two Nozzle rows 231 and 232 are provided, and nozzles 23 are arrayed in a direction orthogonal to the conveyance direction of the recording medium 10 (direction of an arrow X).

The present embodiment is a case where the drive pulse generation circuit has three time sharing drive waveform generation circuits (n=3), the time sharing drive 2 is delayed by Δt from the time sharing drive 1, the time sharing drive 3 is delayed by Δt from the time sharing drive 2. In this case also, as illustrated in FIG. 11, a single piezoelectric element is or two or more adjacent piezoelectric elements are set as one block, and each block is allocated to any one of the first to third sets in a manner similar to the above-described case. Assume that a set of piezoelectric elements to which the time sharing drive 1 is applied (first set) is defined as "A", a set of piezoelectric elements to which the time sharing drive 2 is applied (second set) is defined as "B", and a set of piezoelectric elements to which the time sharing drive 3 is applied (third set) is defined as "C".

In a so-called single pass printer or the like, as illustrated in FIG. 11, a plurality of nozzle rows 231 and 232 parallel to each other is arranged in the conveyance direction of the recording medium 10 (direction of an arrow X). In this case, in a case of having a concentration difference in jetted ink between respective sets of the piezoelectric elements in each of the nozzle rows 231 and 232 and the concentration distribution has a similar tendency in each of the nozzle rows 231 and 232, largely non-uniform concentration distribution may be caused in a formed image.

Therefore, each set of piezoelectric elements in the first nozzle row 231 and each set of piezoelectric elements in the second nozzle row 232, which are located at positions corresponding to each other, are made to have concentrations deviated oppositely from an average concentration. As a result, the concentration distribution in each of the nozzle rows 231 and 232 can be canceled out and made uniform.

More specifically, in a case where a relation between concentrations of jetted ink between respective sets of piezoelectric elements are "A>B>C" and a concentration of the ink jetted from the set "B" of piezoelectric elements is set as an average concentration of A, B, C, when the respective sets of piezoelectric elements in the first nozzle row 231 are arrayed as "A, B, C, B, A, B, C, . . . , B, A, B, C", respective sets of piezoelectric elements in the second nozzle row 232 are arrayed such that the respective sets have concentrations deviated oppositely from the average concentration, for example, by arraying "C for A (of the first nozzle row)", "B for B (of the first nozzle row)", "A for C (of the first nozzle row)", "B for B (of the first nozzle row)", and "C for A (of the first nozzle row)".

Thus, since each set of piezoelectric elements in the array of the certain nozzle row 231 and each set of piezoelectric elements in the array of the nozzle row 232, which are located at positions corresponding to each other, are made to have concentrations deviated oppositely from the average concentration, concentration distribution in each of the nozzle rows 231 and 232 can be canceled out and the concentration distribution in a formed image can be made uniform. Meanwhile, even in a case where the number of nozzle rows is an odd number, influence of concentration distribution in each of nozzle rows can be reduced.

Another Embodiment (1)

In an inkjet recording device or the like in which a temperature control function is not provided to a carriage on which an inkjet head is installed, in a case of jetting ink desired to be driven at a temperature higher than an ambient temperature, a speed (droplet speed) of the ink jetted may be varied in each set of piezoelectric elements. The reason is that heat of the inkjet head escapes through a fixing portion to the carriage and a temperature in the vicinity of the fixing portion is decreased lower than a set temperature of the inkjet head, and such temperature distribution influences viscosity of the ink and driving efficiency of a piezoelectric element.

In the present embodiment, utilizing a deviation amount of jet timing between sets of piezoelectric elements caused by a deviation between respective time sharing drive waveforms, a drive pulse having early jet timing is applied to a set of piezoelectric elements having delayed jet timing due to influence of temperature distribution, and a drive pulse having delayed jet timing is applied to a set of piezoelectric elements having jet timing not delayed, and therefore, the influence of the temperature distribution and the like can be canceled out and the jet timing can be made uniform.

Another Embodiment (2)

In an above description, described is a case where an inkjet recording device is a line type, but the present invention is not limited thereto and can be suitably used in an inkjet recording device of a serial type (also referred to as a shuttle type) in which recording is performed while an inkjet head reciprocates in a direction orthogonal to a conveyance direction of a recording medium (shuttle motion).

Additionally, in the above description, described a case where an inkjet head included in an inkjet recording device is a shear mode type, but in the present invention, a form of distortion of a piezoelectric element in an inkjet head is not particularly limited, and for example, not only the shear mode but also a deflection mode (bend mode), a longitudinal mode (also referred to as a push mode or a direct mode), or the like can be preferably applied, and particularly, the shear mode is preferable.

Since a drive pulse is defined with reference to an acoustic length (AL: ½ of an acoustic resonance period of the pressure chamber, the present invention is applicable to various kinds of inkjet recording devices regardless of a form of distortion of a piezoelectric element or a volume/shape of a pressure chamber as far as an inkjet recording device has a mechanism in which, in principle, a wall of a pressure chamber filled with ink is deformed by a piezoelectric element and the ink is jetted from a nozzle by changing the volume of the pressure chamber.

Another Embodiment (3)

Figure 12:
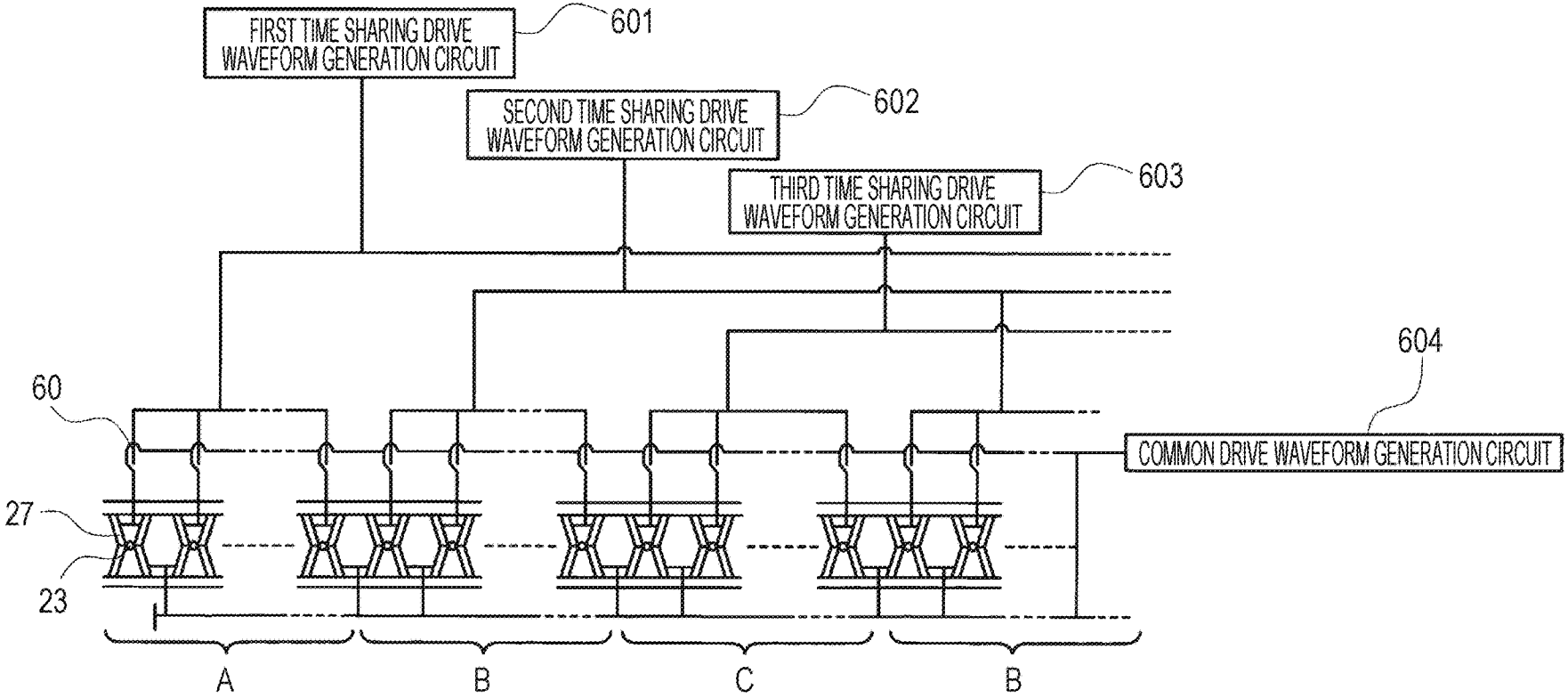
FIG. 12 is a diagram view illustrating wiring in a so-called independent type inkjet head.

FIG. 12 is a view illustrating wiring in a so-called independent type inkjet head in which a jetting channel and a non-jetting channel are alternately provided.

As illustrated in FIG. 12, the present invention is also applicable to the so-called independent type inkjet head. In the independent type inkjet head, adjacent ink channels can be expanded or contracted at the same time, and independent drive can be performed. In this case, a plurality of piezoelectric elements 27 of the inkjet head is divided into first to n-th sets (n=3 in the present embodiment). How to array respective sets (A, B, C) of respective piezoelectric elements 27 is similar to that in an above-described embodiment. A first time sharing drive waveform generation circuit 601 is connected to each piezoelectric element 27 in a first set (A) via each switching element 60. Similarly, a second time sharing drive waveform generation circuit 602 is connected to each piezoelectric element 27 in a second set (B) via a switching element 60, and a third time sharing drive waveform generation circuit 603 is connected to each piezoelectric element 27 in a third set (C) via each switching element 60.

Additionally, a common drive waveform generation circuit 604 is connected to each piezoelectric element 27 in each of the sets (A, B, C) via each switching element 60.

As illustrated in FIG. 7 and FIG. 8, during a period in which the first to third time sharing drive waveform generation circuits 601, 602, and 603 generate time sharing drive waveforms, each switching element 60 is switched to a side of each of the time sharing drive waveform generation circuits 601, 602, and 603 such that each time sharing drive pulse (drive pulse based on a time sharing drive waveform) is applied to each piezoelectric element 27 in each of the sets (A, B, C). Then, during a period in which the common drive waveform generation circuit 604 generates a common drive waveform, each switching element 60 is switched to a side of the common drive waveform generation circuit 604 such that the common drive pulse (drive pulse based on a common drive waveform) is applied to each piezoelectric element 27 of each of the sets (A, B, C). Such switching of each switching element 60 is repeated every set time (one pixel period).

Thus, each piezoelectric element 27 in each of the sets (A, B, C) is applied every set time (one pixel period) with a drive pulse having a waveform combining a time sharing drive waveform generated by one of the time sharing drive waveform generation circuits 601, 602, and 603 with a common drive waveform generated from the common drive waveform generation circuit 604.

Another Embodiment (4)

In a case where the present invention is applied to a so-called three-cycle drive inkjet head, a drive pulse is applied to a pressure generating element in each ink channel by using, in combination, a drive pulse generation circuit described above and a three-cycle drive circuit in which all of ink channels are divided into three groups and time sharing control is performed for adjacent ink channels. In other words, the present invention is applied to the three-cycle drive inkjet head by superimposing, on a drive pulse generated by the above-described drive pulse generation circuit, time sharing control for adjacent ink channels by the three-cycle drive circuit. In other words, wave separation and delay are performed between a plurality of sets of pressure generating elements by drive pulse generation circuits of the present invention while keeping a state in which the time sharing control for the adjacent ink channel is performed by the three-cycle drive circuit.

Another Embodiment (5)

Figure 13A:
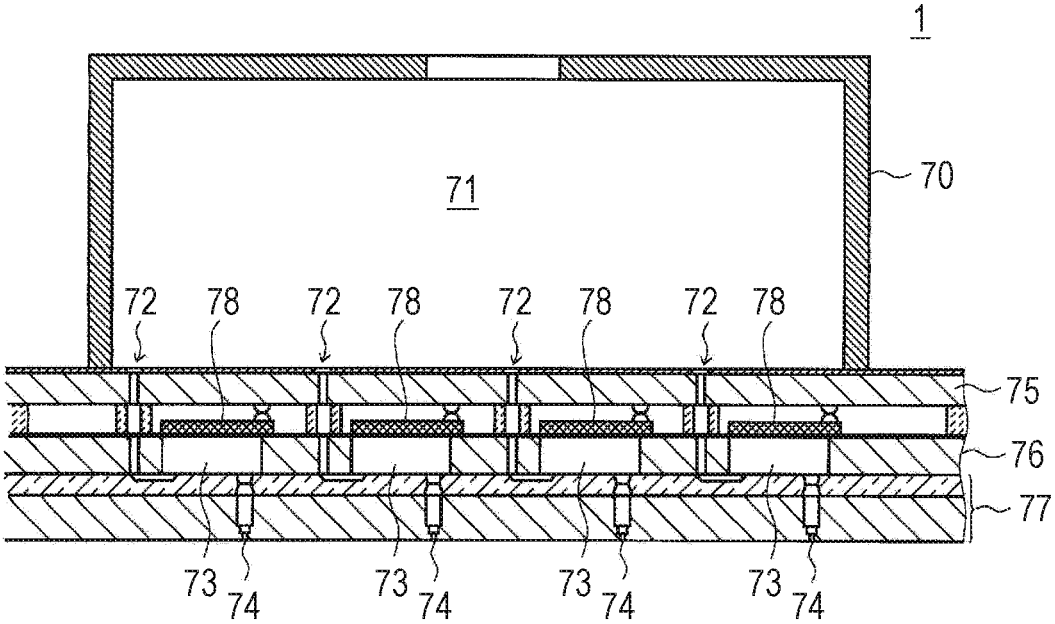
FIG. 13A and FIG. 13B illustrate diagrams illustrating an example of a so-called MEMS type inkjet head.
Figure 13B:
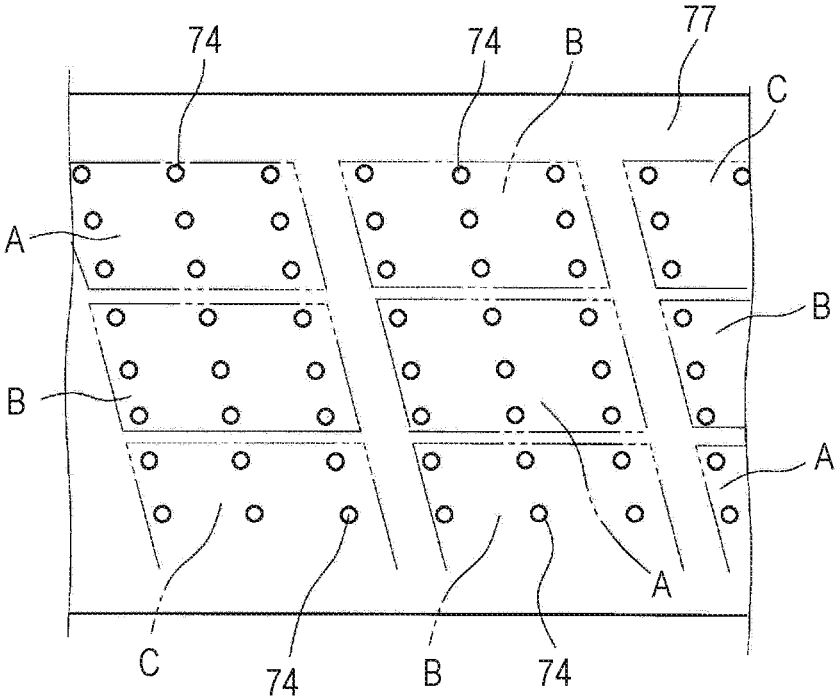

FIG. 13A and FIG. 13B are views illustrating an example of a so-called MEMS type inkjet head in which a plurality of ink channels is two-dimensionally arranged, FIG. 13A is a sectional view from a side surface, and FIG. 13B is a bottom view of a nozzle surface from the bottom surface.

As illustrated in FIG. 13A, the so-called MEMS type inkjet head has an ink manifold 70 constituting a common ink chamber 71. An open bottom portion of the ink manifold 70 is closed by an upper substrate 75. The common ink chamber 71 is filled with supplied ink.

A lower substrate 76 is arranged parallel to the upper substrate 75 below the upper substrate 75. A plurality of piezoelectric elements 78 is arranged between the upper substrate 75 and the lower substrate 76. These piezoelectric elements 78 are each applied with a drive pulse via a wiring pattern (not illustrated) formed on a lower surface of the upper substrate 75. A plurality of pressure chambers 73 is provided in a manner corresponding to these piezoelectric elements 78. These pressure chambers 73 are through holes formed at the lower substrate 76, and upper portions thereof are closed by corresponding piezoelectric elements 78, and bottom portions thereof are closed by a nozzle plate 77. The nozzle plate 77 is bonded to a lower surface of the lower substrate 76.

Each pressure chamber 73 has a bottom portion communicating with the common ink chamber 71 via an injection hole 72 and a groove formed on an upper surface of the nozzle plate 77, and the injection holes are formed in a manner corresponding to the respective pressure chambers 73 and penetrate the upper substrate 75 and the lower substrate 76. The ink inside the common ink chamber 71 is supplied into the respective pressure chambers 73 via the injection holes 72 and the groove formed on the upper surface of the nozzle plate 77. Additionally, the respective pressure chambers 73 communicate with an outer side (lower side) via respective nozzles 74 formed on the nozzle plate 77 in a manner corresponding to the respective pressure chambers 73.

In this inkjet head, when a drive pulse is applied to a piezoelectric element 78, a volume of a corresponding pressure chamber 73 is changed (contracted), and the ink in the pressure chamber 73 is jetted outward (downward) via a nozzle 74.

In this inkjet head, as illustrated in FIG. 13B, the nozzles 74 are two-dimensionally arranged on the lower surface of the nozzle plate 77. The piezoelectric elements 78 are also two-dimensionally arranged in a manner corresponding to the nozzles 74.

In the case where the present invention is applied to this inkjet head, piezoelectric elements 78 are divided into the first set to the n-th set (where n is an integer of 2 or more) A, B, C, . . . , n while setting, as one set, the piezoelectric elements 78 corresponding to the plurality of adjacent nozzles 74 arranged in one row or a plurality of rows. More specifically, the piezoelectric elements belonging to one set are arranged in one row or two-dimensional manner.

Then, a drive pulse is generated by using a drive pulse generation circuit described in the above embodiment, and piezoelectric elements in each set are made to correspond to a common drive waveform generation circuit and any one of the respective time sharing drive waveform generation circuits, and a corresponding drive pulse is applied to each of the piezoelectric elements such that the same drive pulse is applied at the same timing to each of the piezoelectric element belonging to the same set. Thus, the present invention is applicable in a manner similar to the above embodiment.

EXAMPLES

In the following, examples of the present invention will be described, but the present invention is not limited by the examples.

<Inkjet Recording Device>

An inkjet recording device used in the following tests is a shear mode type inkjet recording device in which ink is jetted from a nozzle by deforming a wall of a pressure chamber filled with the ink by a piezoelectric element and changing a volume of the pressure chamber.

<Effects of Reducing Instantaneous Power Consumption>

In the following Example, an effect of reducing instantaneous power consumption was confirmed by changing a minimum value (Δt) of a deviation amount of application timing of time sharing drive pulses with respect to a falling time (t) of a pulse that was a waveform element of a time sharing drive waveform. The effect of instantaneous power consumption was evaluated by changing (Δt/t) from 0% to 200%.

Evaluation was made, while driving all rows in an evaluation target head in full duty, on the basis of whether a landing deviation of one pixel or more was caused by a temporal change amount in an ink jet speed under printing conditions assumed in the evaluation target head.

TABLE 1

| MINIMUM VALUE OF APPLICATION TIMING DEVIATION AMOUNT (Δt)/WAVEFORM FALLING TIME (t) | EFFECT OF REDUCING INSTANTANEOUS POWER CONSUMPTION |
|---|---|
| 0% | X |
| 50% | ○ |
| 75% | ○ |
| 100% | ○ |
| 200% | ○ |

<Evaluation>

It can be confirmed from Table 1 that: in a case where (Δt/t) was 0%, there was no effect of reducing the instantaneous power consumption; and in a case where (Δt/t) was 50% or more, the effect of reducing the instantaneous power consumption was obtained without causing a landing deviation of one pixel or more.

<Ink Jetting State>

In the Example below, an ink jetting state was confirmed by changing a maximum value ((n−1)Δt) of a deviation amount of the application timing of a time sharing drive pulse with respect to an acoustic length (AL: ½ of an acoustic resonance period of a pressure chamber). Evaluation was made on the ink jetting state while changing ((n−1)Δt/AL) from 0% to 25%.

Evaluation was made on the basis of whether weak jetting is not caused during observation on an ink jetting state by piezoelectric elements applied with n time sharing drive pulses under the conditions that a common power source is used to determine wave peak values of the n time sharing drive pulses and the wave peak values of all of the time sharing drive pulses are made equal.

TABLE 2

| MAXIMUM VALUE OF APPLICATION TIMING DEVIATION AMOUNT ((n − 1)Δt)/AL | INK JETTING STATE |
|---|---|
| 0% | ○ |
| 5% | ○ |

TABLE 2-continued

| MAXIMUM VALUE OF APPLICATION TIMING DEVIATION AMOUNT ((n − 1)Δt)/AL | INK JETTING STATE |
|---|---|
| 10% | ○ |
| 15% | ○ |
| 20% | Δ |
| 25% | X |

<Evaluation>

It was found from Table 2 that no weak jetting state was not caused in a case where ((n−1) Δt/AL) was 0% to 15%. It could be confirmed that a weak jetting state was caused and the ink jetting state was deteriorated in a case where ((n−1)Δt/AL) exceeded 20%. Therefore, preferably, ((n−1) Δt/AL) is 20% or less.

REFERENCE SIGNS LIST

1 Inkjet recording device
22 Nozzle plate
23 Nozzle
27 Partition wall
28 Channel
29 Electrode
31 Inkjet head
300 Connection electrode
310 Head chip
6 Flexible cable
501 Control unit
502 Memory
503 Separator
504 Drive pulse generator
505 Inkjet head
**506*a*** First delay circuit
**506*b*** Second delay circuit
**506*c*** Third delay circuit
**506*n*** N-th delay circuit

The invention claimed is:

1. An inkjet recording device comprising:

an inkjet head having a plurality of nozzles and a plurality of pressure generating elements corresponding to the nozzles, the inkjet head being adapted to jet ink from each of the nozzles; and a drive pulse generation circuit that applies drive pulses to the plurality of pressure generating elements, wherein the drive pulse generation circuit includes: first to n-th time sharing drive waveform generation circuits (n is an integer of 2 or more) respectively generating n time sharing drive waveforms obtained by delaying a part of a rendering waveform by a time different from each other, and having application timing deviated from each other; and a common drive waveform generation circuit generating a waveform of a remaining part of the rendering waveform, the plurality of pressure generating elements is divided into first to n-th sets (n is an integer of 2 or more), and pressure generating elements in each set correspond to the common drive waveform generation circuit and any one of the time sharing drive waveform generation circuits, the drive pulse generation circuits apply, per certain set time, drive pulses to the pressure generating elements made to correspond to the drive pulse waveform generation circuits, and each drive pulse being a combination waveform combining a time sharing drive waveform generated from each time sharing drive waveform generation circuit with a common drive waveform generated from the common drive waveform generation circuit, and each of the time sharing waveform generation circuits is formed of one circuit that generates a time sharing drive waveform having earliest application timing and n−1 circuits that include delay circuits having delay amounts different from each other.

2. The inkjet recording device according to claim 1, wherein a voltage change point of one of the n time sharing drive waveforms temporally coincides with a voltage change point of at least one of the common drive waveforms.

3. The inkjet recording device according to claim 2, wherein a minimum value Δt of a timing deviation between the n time sharing drive waveforms is 50% or more of a falling time of a waveform element of the time sharing drive waveform.

4. The inkjet recording device according to claim 2, wherein wave peak values of the n time sharing drive waveforms are equal, and a maximum value (n−1)Δt of a timing deviation between the time sharing drive waveforms is 20% or less of ½ of an acoustic resonance period of a pressure chamber communicating with the nozzle and having a volume changed by the pressure generating element.

5. The inkjet recording device according to claim 1, wherein a minimum value Δt of a timing deviation between the n time sharing drive waveforms is 50% or more of a falling time of a waveform element of the time sharing drive waveform.

6. The inkjet recording device according to claim 1, wherein wave peak values of the n time sharing drive waveforms are equal, and a maximum value (n−1)Δt of a timing deviation between the time sharing drive waveforms is 20% or less of ½ of an acoustic resonance period of a pressure chamber communicating with the nozzle and having a volume changed by the pressure generating element.

7. The inkjet recording device according to claim 1, wherein pressure generating elements in adjacent sets among the sets of pressure generating elements in the inkjet head are each applied with a drive pulse having a time sharing drive waveform in which a timing deviation is a minimum value is Δt.

8. The inkjet recording device according to claim 1, wherein the plurality of nozzles is arranged in a plurality of rows in the inkjet head, an array of respective time sharing drive waveform generation circuits that apply drive pulses to respective sets of the pressure generating elements in a certain nozzle row is made to have an inverted array of an array of respective time sharing drive waveform generation circuits that apply drive pulses to respective sets of the pressure generating elements in another nozzle row.

9. The inkjet recording device according to claim 1, wherein the plurality of nozzles is arranged in a plurality of rows in the inkjet head, and there is a concentration difference in a formed image between respective sets of the pressure generating elements in a certain nozzle row, and respective sets of pressure generating elements in the certain nozzle row and respective sets of pressure generating elements in the other nozzle row located at positions corresponding to the respective sets of the pressure generating elements in the certain row are made to have concentrations deviated oppositely from an average concentration.

10. The inkjet recording device according to claim 1, wherein there is a factor that causes a difference in droplet speed between respective sets of the pressure generating elements in the inkjet head, and influence of the factor is canceled out by a deviation between the respective time sharing drive waveforms.

11. An inkjet head driving method comprising:

generating n time sharing drive waveforms (n is an integer of 2 or more) obtained by delaying a part of a rendering waveform by a time different from each other and having application timing deviated from each other, and generating a common drive waveform that is a remaining part of the rendering waveform;

dividing, into first to n-th sets (n is an integer of 2 or more), the plurality of pressure generating elements respectively corresponding to a plurality of nozzles in the inkjet head, and making pressure generating elements of each set correspond to any one of the respective time sharing drive waveforms and the common drive waveforms; and selecting one time sharing drive waveform every set time, and applying to a drive pulse to a pressure generating element made to correspond to the drive waveforms, each drive pulse having a combination waveform combining the selected time sharing drive waveform with the common drive waveform, wherein the respective time sharing drive waveforms are generated by using time sharing drive waveform generation circuits including: one circuit that generates a time sharing drive waveform having earliest application timing; and n−1 circuits having delay circuits in which delayed amounts are different from each other.

12. The inkjet head driving method according to claim 11, wherein a voltage change point of one of the n time sharing drive waveforms temporally coincides with a voltage change point of at least one of the common drive waveforms.

13. The inkjet head driving method according to claim 11, wherein a minimum value $\Delta t$ of a timing deviation between the n time sharing drive waveforms is 50% or more of a falling time of a waveform element of the time sharing drive waveform.

14. The inkjet head driving method according to claim 11, wherein wave peak values of the n time sharing drive waveforms are equal, and a maximum value $(n-1)\Delta t$ of a timing deviation between the time sharing drive waveforms is 20% or less of ½ of an acoustic resonance period of a pressure chamber communicating with the nozzle and having a volume changed by the pressure generating element.

15. The inkjet head driving method according to claim 11, wherein pressure generating elements in adjacent sets among the sets of pressure generating elements in the inkjet head are applied with drive pulses each having a time sharing drive waveform in which a timing deviation is a minimum value is $\Delta t$.

16. The inkjet head driving method according to claim 11, wherein the plurality of nozzles is arranged in a plurality of rows in the inkjet head, an array of respective time sharing drive waveform generation circuits that apply drive pulses to respective sets of the pressure generating elements in a certain nozzle row is made to have an inverted array of an array of respective time sharing drive waveform generation circuits that apply drive pulses to respective sets of the pressure generating elements in another nozzle row.

17. The inkjet head driving method according to claim 11, wherein the plurality of nozzles is arranged in a plurality of rows in the inkjet head, and there is a concentration difference in a formed image between respective sets of the pressure generating elements in a certain nozzle row, and respective sets of pressure generating elements in the certain nozzle row and respective sets of pressure generating elements in the other nozzle row located at positions corresponding to the respective sets of the pressure generating elements in the certain row are made to have concentrations deviated oppositely from an average concentration.

18. The inkjet head driving method according to claim 11, wherein there is a factor that causes a difference in droplet speed between respective sets of the pressure generating elements in the inkjet head, and influence of the factor is canceled out by a deviation between the respective time sharing drive waveforms.

19. An inkjet recording device comprising:

an inkjet head having a plurality of nozzles and a plurality of pressure generating elements corresponding to the nozzles, the inkjet head being adapted to jet ink from each of the nozzles; and a drive pulse generation circuit that applies drive pulses to the plurality of pressure generating elements, wherein the drive pulse generation circuit includes:

a common drive waveform generation circuit generating a rendering waveform including an expansion waveform and a contraction waveform;

first to n-th time sharing drive waveform generation circuits (n is an integer of 2 or more) respectively generating n time sharing drive waveforms obtained by delaying the expansion waveform or the contraction waveform of the rendering waveform by a time different from each other, and having application timing deviated from each other; and a drive pulse generator generating n sets of drive pulses set to a predetermined drive voltage value by combining the contraction waveform with each of the n time sharing drive waveforms when the expansion waveform is delayed, or a drive pulse generator generating n sets of drive pulses set to a predetermined drive voltage value by combining the expansion waveform with each of the n time sharing drive waveforms when the contraction waveform is delayed, the plurality of pressure generating elements is divided into first to n-th sets (n is an integer of 2 or more), and pressure generating elements in each set correspond to any one of the first to n-th time sharing drive waveform generation circuits and the common drive waveform generation circuit, and the drive pulse generation circuit applies, per certain set time, a plurality of drive pulses to the pressure generating elements made to correspond to any one of the first to n-th time sharing drive waveform generation circuits and the common drive waveform generation circuit.

20. An inkjet head driving method comprising:

generating n time sharing drive waveforms (n is an integer of 2 or more) obtained by delaying an expansion waveform or a contraction waveform of a rendering waveform including the expansion waveform and the contraction waveform by a time different from each other, and having application timing deviated from each other;

generating n sets of drive pulses set to a predetermined drive voltage value by combining the contraction waveform with each of the n time sharing drive waveforms when the expansion waveform is delayed, or generating n sets of drive pulses set to a predetermined drive voltage value by combining the expansion waveform with each of the n time sharing drive waveforms when the contraction waveform is delayed;

dividing the plurality of pressure generating elements corresponding to a plurality of nozzles of an inkjet head into first to n-th sets (n is an integer of 2 or more), and making pressure generating elements in each set correspond to any one of the n time sharing drive waveforms and the common drive waveform; and applying, per certain set time, a plurality of drive pulses to the pressure generating elements made to correspond to any one of the n time sharing drive waveforms and the common drive waveform.

* * * * *